US008302898B2

(12) United States Patent
Tropper et al.

(10) Patent No.: US 8,302,898 B2
(45) Date of Patent: Nov. 6, 2012

(54) DEVICE FOR CONTINUOUS REELING OF A PULP WEB

(75) Inventors: Gernot Tropper, Graz (AT); Wilhelm Mausser, Graz (AT); Robert Schloffer, Graz (AT); Gerald Martiner, Graz (AT)

(73) Assignee: Andritz AG, Graz (AT)

( * ) Notice: Subject to any disclaimer, the term of this patent is extended or adjusted under 35 U.S.C. 154(b) by 234 days.

(21) Appl. No.: 12/800,605

(22) Filed: May 19, 2010

(65) Prior Publication Data

US 2010/0301156 A1 Dec. 2, 2010

(30) Foreign Application Priority Data

May 22, 2009 (AT) ..... A 801/2009

(51) Int. Cl.
*B65H 18/14* (2006.01)

(52) U.S. Cl. ..... 242/541; 242/541.1; 242/541.4; 242/541.5; 242/541.6; 242/541.7

(58) Field of Classification Search ..... 242/541, 242/541.1, 541.4–541.7, 542.3, 547
See application file for complete search history.

(56) References Cited

U.S. PATENT DOCUMENTS 3,877,654 A * 4/1975 Randpalu et al. ..... 242/533.1
4,634,068 A * 1/1987 Malkki et al. ..... 242/541.7
5,249,758 A * 10/1993 Muller et al. ..... 242/533.3
5,308,008 A * 5/1994 Ruegg ..... 242/541.7
5,845,868 A * 12/1998 Klerelid et al. ..... 242/541
6,036,137 A * 3/2000 Myren ..... 242/541.7
6,325,323 B1 * 12/2001 Olsson ..... 242/541.7
6,550,713 B1 * 4/2003 Ruha et al. ..... 242/541.7
7,959,102 B2 * 6/2011 Lanz ..... 242/541.1

FOREIGN PATENT DOCUMENTS

AT 411 590 B 3/2004

* cited by examiner

*Primary Examiner* — Sang Kim
(74) *Attorney, Agent, or Firm* — Alix, Yale & Ristas, LLP

(57) ABSTRACT

The invention relates to a device for continuous reeling of a pulp web (1), particularly a paper web, for example tissue, where the pulp web (1) is carried over a reel drum (2) that is supported on rocker arms (4) and is then wound onto a winding unit (5), and the pressing force in the nip (24) is measured between paper roll (16) and reel drum (4) with the aid of a load-sensing device (7), where the rocker arm (4) can be preloaded against the load-sensing device (7), where the rocker arm (4) can be preloaded against the load-sensing device (7) by means of a preloading element (8). It is mainly characterized by the preloading force for preloading the rocker arm (4) against the load-sensing device (7) being adjustable by means of the preloading element (8).

18 Claims, 4 Drawing Sheets

DEVICE FOR CONTINUOUS REELING OF A PULP WEB

BACKGROUND

The present invention relates to a device for continuous reeling of a pulp web, particularly a paper web, for example tissue.

The pulp web is carried over a reel drum that is supported at one end on a vertical rocker arm and is then wound onto a winding unit, and the load between the rocker arm and a fixed counterpart is measured by means of a load-sensing device, where the rocker arm can be preloaded against the load-sensing device by means of a preloading element. The pressing force in the nip between the horizontal reel and the reel drum can be measured using this load-sensing device at the rocker arm.

A device of this kind is described in AT 411 590 B (Andritz AG). A load-sensing device determines the pressing force in the nip, located directly between the respective rocker arm and a fixed counterpart in the paper machine frame. Before operations begin, each load-sensing device is preloaded against the respective rocker arm by means of preloading elements. This preloading is necessary because the oscillation and vibrations by the reel drum distort the measuring result. For the purposes of this preload, preloading elements press against the load-sensing devices, thus sustained contact can be guaranteed between the rocker arm and the load-sensing device, and a continuous signal is provided for control purposes. The preloading elements in AT 411 590 B are operated either mechanically (e.g. via springs or spring stacks) or they are operated hydraulically or pneumatically and always tension the rocker arms with a constant load against the respective load-sensing device. After the swivelling levers have been preloaded, the load-sensing devices are calibrated to nip force zero. Then a selected nip force is transferred via the paper roll to the reel drum by the hydraulic cylinders (or pneumatic cylinders) of the primary and secondary arms during operations. This force is measured by the load-sensing devices and the measurement result is used to control the hydraulic cylinders of the primary and secondary arms.

Preloading of the load-sensing device to a constant value before beginning operations has the disadvantage that this preloading weakens in the course of time and as a result of vibrations. Thus, it is not possible to obtain an exact measurement of the nip force. Preloading of the load-sensing device must thus be checked from time to time and re-adjusted; however, this can only be done during a plant shutdown. In addition, the preloading elements are not easily accessible, thus readjustment is very complicated. In addition, preloading of mechanical elements is relatively inaccurate.

A further problem is the changes in the length of the fastening elements for the load-sensing device and preloading elements caused by heat during operation. The tension also changes during operation as a result, leading to fluctuating measurements.

SUMMARY

The object of the invention is to provide a device that eliminates the disadvantages mention, thus providing good controllability during the reeling process, even at very low pressing forces.

According to an aspect of the invention, the force for preloading the rocker arm against the load-sensing device by means of the preloading element is adjustable during reeling operations. Thus, there is no longer any need to compress the load-sensing device during assembly work. It is much easier and faster to install a load-sensing device that does not require preloading. The preloading force on the load-sensing device can be adjusted or corrected at any time afters installation. Furthermore, it is possible to select the optimum preloading force for the respective type of pulp. It may be necessary to use different nip forces for different types of pulp, and it makes sense to be able to readjust the preload force accordingly. It would also be feasible to conduct operations without any preload force.

Of course, it would also be conceivable to modify the preload force continually during the winding process of a horizontal reel.

In an advantageous embodiment of the invention the preloading element is an adjustable hydraulic cylinder. Then it is particularly easy to set the preload force by means of the pressure in the hydraulic cylinder, also during operation. For this purpose the hydraulic cylinder is connected to a hydraulic line with a suitable control device.

Similarly, the preloading element can be provided in the form of an adjustable pneumatic cylinder.

In a further embodiment, the load-sensing device is mounted in a recess in the rocker arm and connected to a fixed counterpart via a fastening element. As the load-sensing device is mounted in the rocker arm, it is protected against damage from ambient conditions, such as dust, for example, or sudden fluctuations in temperature.

The load-sensing device can, however, also be mounted between the rocker arm and the fixed counterpart. The rocker arm can thus have a simpler design, and mounting or changing of the load-sensing device is easier.

Desirably, the bearing assembly of the reel drum is located inside a bearing assembly for a primary arm and is uncoupled from the primary arm bearing assembly. As a result, the bearing assembly for the reel drum and the bearing assembly of the primary arm lie largely in a single axis on a single level, thus the forces generated by the nip force can be absorbed more effectively by the machine frame.

BRIEF DESCRIPTION OF THE DRAWING

The preferred embodiment is described in greater detail below with reference to the drawing, in which.

DETAILED DESCRIPTION

Figure 1:
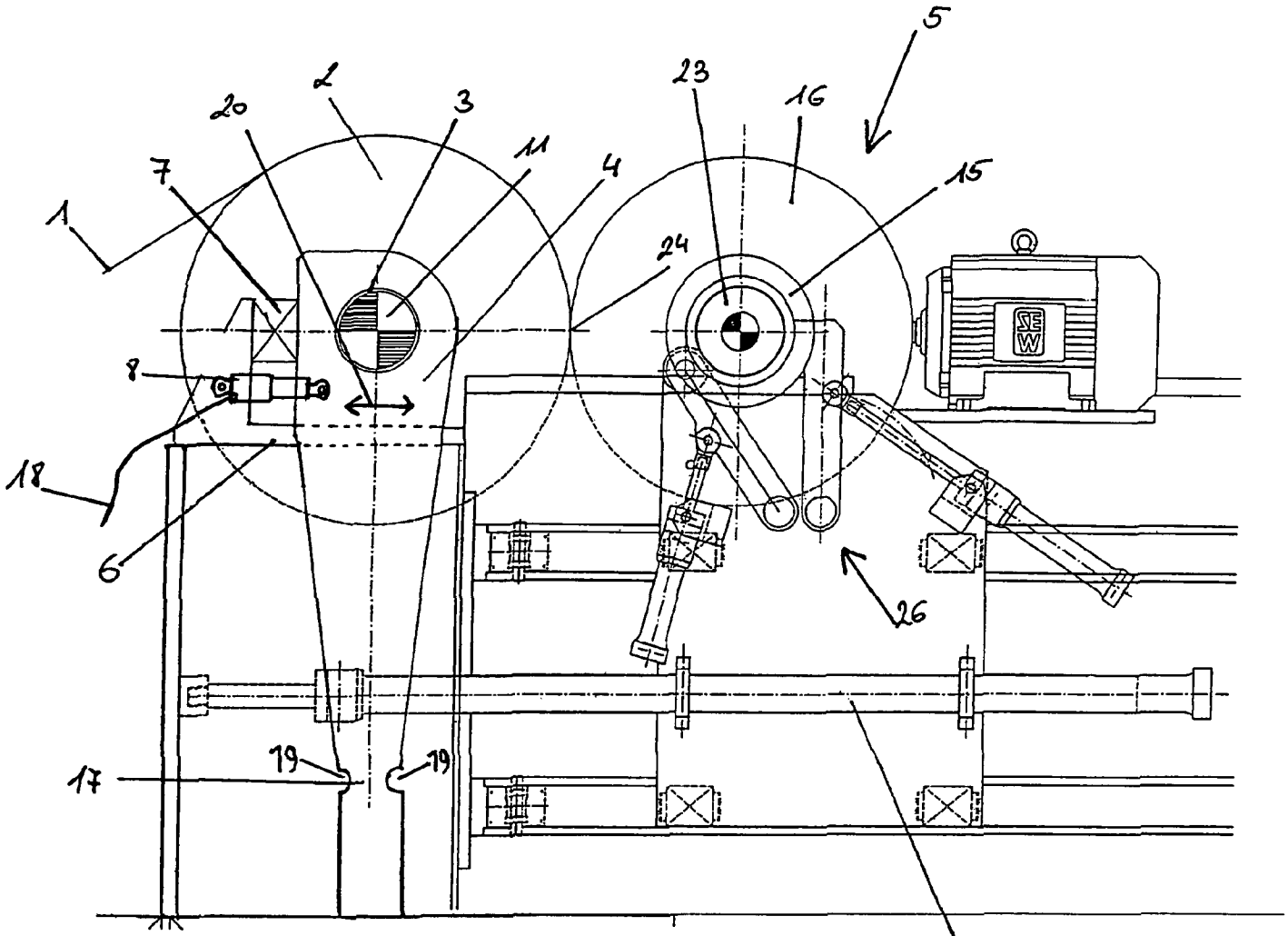
FIG. 1 shows an embodiment of the invention for continuous reeling of a pulp web.

Identical reference numerals in the individual figures refer to the same components.

FIG. 1 shows a device according to an embodiment of the invention for reeling of a pulp web 1. The reel drum 2 is supported by two substantially vertical rocker arms 4, with a bearing 11 at one end 3 of each rocker arm. In the present example, the rocker arm 4 has two recesses 19 at the sides at its lower end, which results in an attenuation 17 of the rocker arm 4. This attenuation 17 permits the swinging motion of the rocker arm 4. The swing direction of the rocker arm 4 is indicated by the arrow 20.

The pulp web 1 is wound into a paper roll 16 on a winding core 15 in a winding unit 5 after leaving the reel drum 2. The winding core 15 is placed on a winding shaft 23 guided at both ends by secondary arms 26.

A nip 24 is formed between the reel drum 2 and the paper roll 16. The pressing force of the paper roll 16 and of the winding shaft 23 against the reel drum 2 must be measured and controlled precisely during reeling operations. The pressing force in the nip 24 and the position of the secondary arms 26 are controlled via a hydraulic cylinder 25. The pressing force in the nip 24 is measured by two load-sensing devices 7, each arranged between a respective rocker arm 4, and a fixed counterpart 6. The fixed counterpart 6 is part of the paper machine frame or is firmly attached to the paper machine frame.

The measured value signals recorded control the pressing force of the two hydraulic cylinders 25 in order to ensure that the secondary arms 26 are running absolutely parallel on the operator OS and drive DS sides, and to guarantee a selected nip force progression (constant or changing) throughout the entire winding process.

During winding it is beneficial if the rocker arm 4 is also pressed or preloaded against the load-sensing device 7 in addition to and independently of the pressing element that produces the force in the nip 24. This preload prevents or reduces any distortion of the measuring signal from the load-sensing device 7 as a result of vibrations.

A preloading element 8 is provided for each rocker arm 4 to urge the rocker arm 4 against the load-sensing device 7, where the preload force of these preloading elements 8 is remotely adjustable according to the invention. This may be an adjustable hydraulic cylinder, for example, or an adjustable pneumatic cylinder. The preloading elements 8 are connected to an appropriate control device (not shown) by the hydraulic or pneumatic line 18.

In FIG. 1, the preloading elements 8 are arranged directly beneath the load-sensing device 7, i.e. on the side of the reel drum 2 where the pulp web 1 runs onto the reel drum 2. The preload force is created by contraction of the preloading elements 8.

Figure 2:
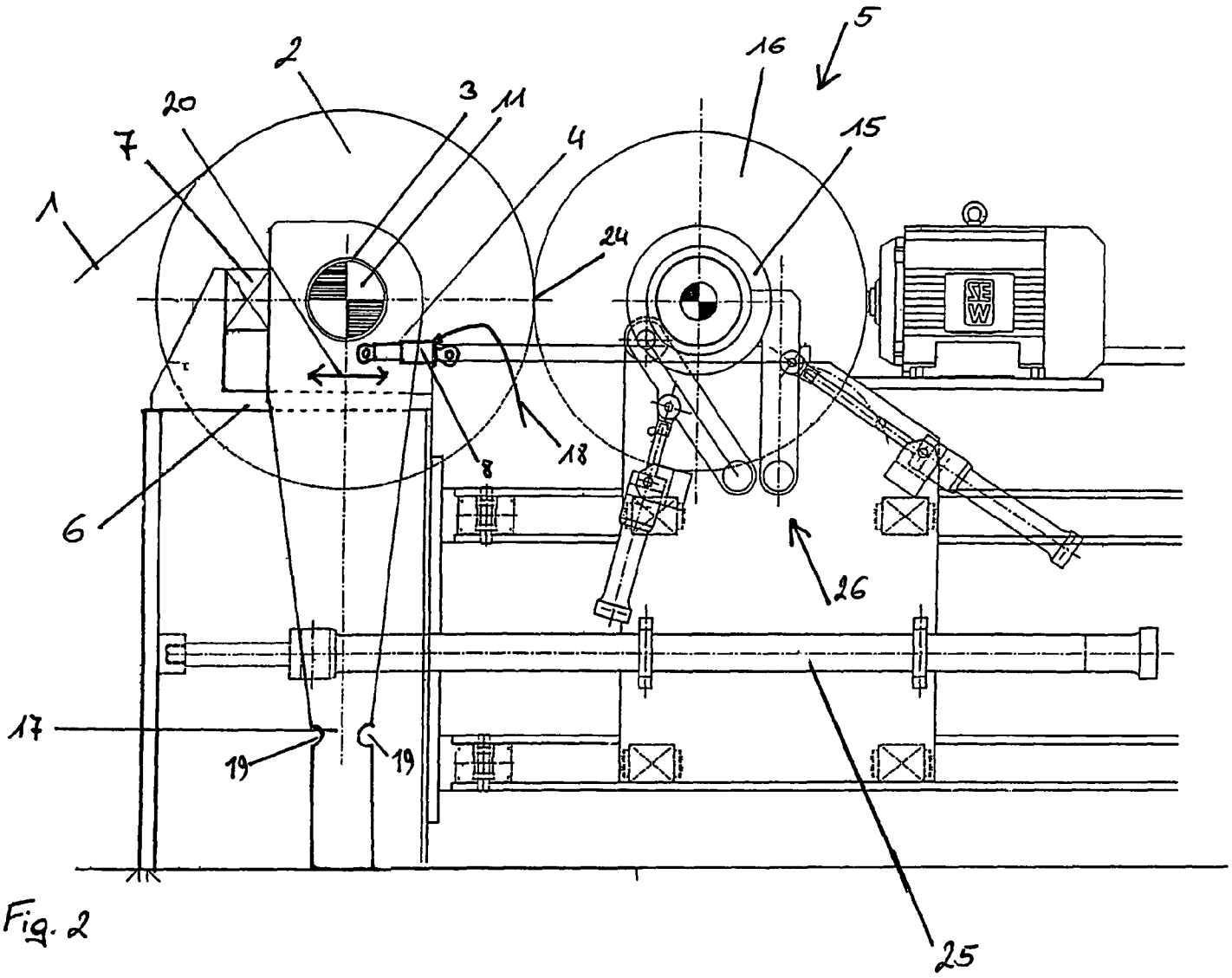
FIG. 2 shows a further embodiment.

The preloading elements 8 can also be arranged on the side of the reel drum 2 on which the pulp web 1 runs off the reel drum 2, i.e. on the nip side. This arrangement is shown in FIG. 2. The preload force is then created by expansion of the preloading elements 8.

Figure 3:
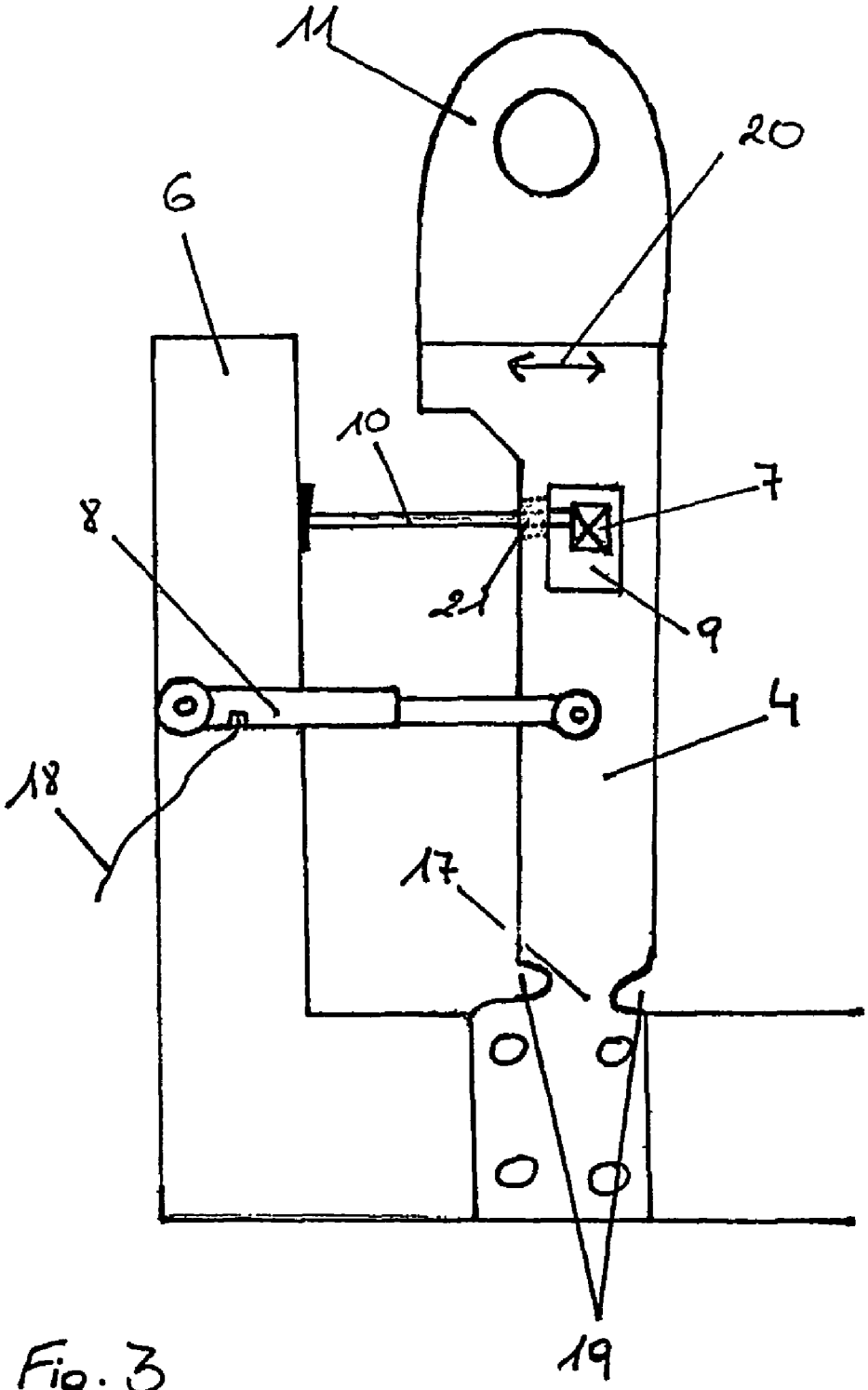
FIG. 3 shows a load-sensing device mounted in a recess in a rocker arm.

FIG. 3 shows a detail of the rocker arm 4 and presents a further embodiment of the invention. Here the load-sensing devices 7 are each housed in a recess 9 of the rocker arm 4 and secured to the rocker arm 4. The rocker arm 4 has a bore 21 through which a connecting element 10 can be laid from the outside into the recess 9. The connecting element 10 is connected to the load-sensing device 7 at one end and to a fixed counterpart 6 on the paper machine frame at the other end. The diameter of the bore hole 21 should be large enough to allow the connecting element 10 to be threaded through without any difficulty and without touching the rocker arm in the process. A force between the rocker arm 4 and a fixed counterpart 6 or connecting element 10 can also be measured by means of the load-sensing device 7. The preload of the load-sensing device 7 is also set here by means of an adjustable preloading element 8.

Figure 4:
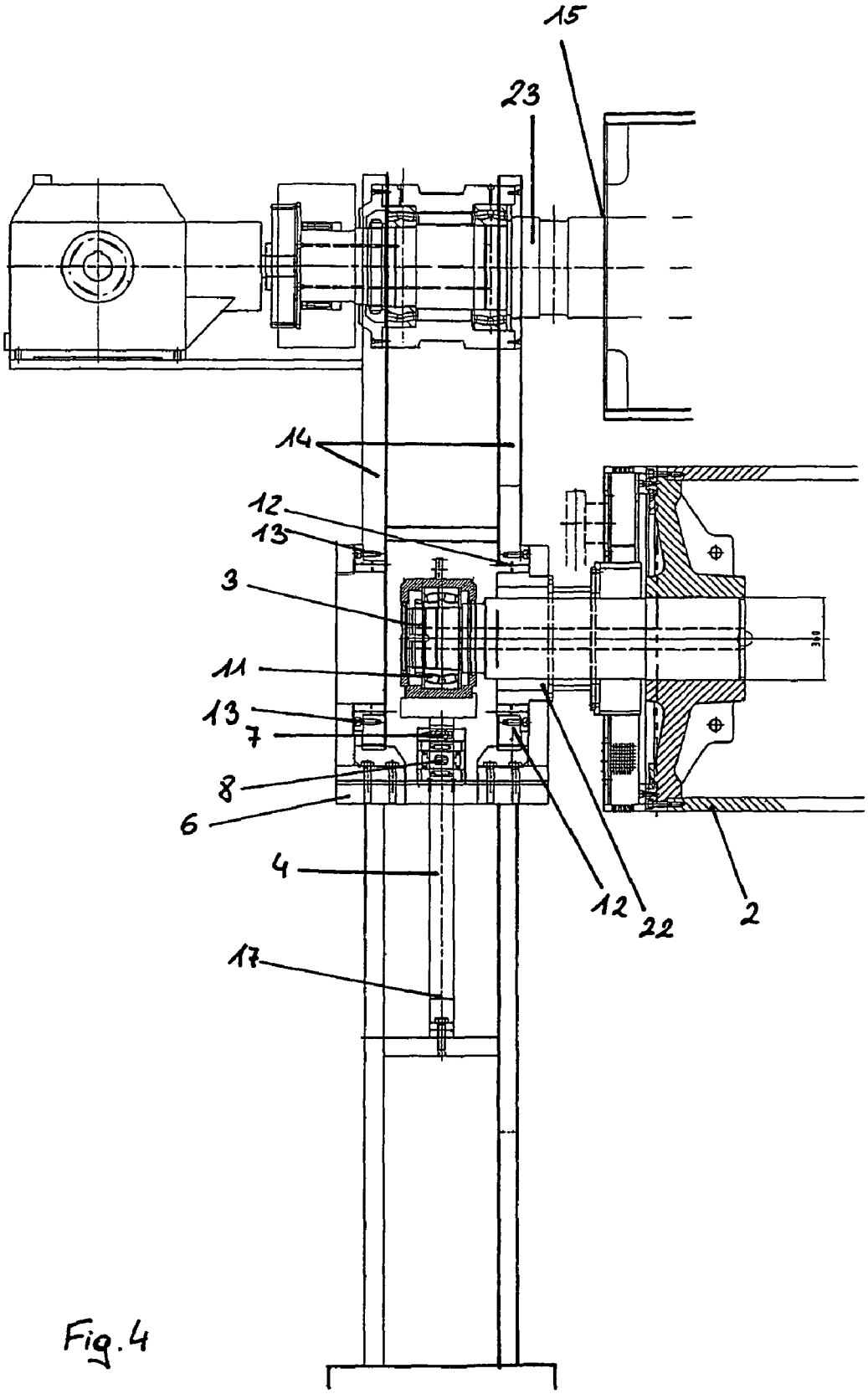
FIG. 4 shows a reel drum assembly inside a primary arm bearing assembly.

FIG. 4 shows a reel drum bearing assembly 11 on the inside of a primary arm bearing assembly 12, 13 in machine running direction. The primary arm 14 holds the core shaft 23, which supports the reel in the first reel phase. The core shaft 23 with the winding core 15 placed on it is still in the primary arm 14 here and not in the secondary arm 26, as shown in FIGS. 1 and 2.

The ends 3 of the reel drum 2 are each supported on the rocker arm 4; this bearing 11 is arranged inside a bearing assembly 12, 13 for the primary arm 14 and uncoupled from the primary arm bearing assembly 12, 13. As a result, the bearing assembly 11 for the reel drum 2 and the bearing assembly 12, 13 of the primary arm 14 lie largely in a single axis on a single level, thus the forces generated by the nip force can be absorbed more effectively by the machine frame. The primary arm bearing assembly 12 has an opening 22 here through which the end 3 of the reel drum 2 or the reel drum shaft passes. Here the opening 22 must be large enough to ensure that the reel drum shaft does not touch the primary arm bearing assembly 12 in spite of the slight oscillating movement of the reel drum 2. In this embodiment, the rocker arm 4 is inside the primary arm frame, as are the load-sensing device 7 and the preloading element 8.

Reeling devices with primary and secondary arms are generally known, as is the reeling process that takes place there, as described in, e.g., Austrian Patent Publication AT 411590.

The invention claimed is:

1. Apparatus for continuous reeling of a pulp web, where the pulp web is carried over a reel drum that is supported at each end on an upper portion of a vertical rocker arm and is then wound onto a winding unit, and where the load between the rocker arm and a fixed counterpart is measured by a load-sensing device, where the rocker arm can be preloaded against the load-sensing device by a preloading element, wherein the improvement comprises that:

a lower portion of the rocker arm has two opposed recesses, which attenuate the rocker arm in a region that permits the swinging motion of the rocker arm; and the preloading force for preloading the rocker arm against the load-sensing device is adjustable by the preloading element during reeling of the pulp web.

2. Apparatus according to claim 1, wherein the preloading element is a hydraulic cylinder.

3. Apparatus according to claim 2, wherein the load-sensing device is mounted in a recess in the upper portion of the rocker arm and connected to said fixed counterpart via a fastening element.

4. Apparatus according to claim 2, wherein a primary arm that holds a core shaft which supports the reel during the reeling phase has a primary bearing assembly and the shaft of the reel drum has another bearing assembly which is located inside and uncoupled from the primary bearing assembly.

5. Apparatus according to claim 1, wherein the preloading element is a pneumatic cylinder.

6. Apparatus according to claim 5, wherein the load-sensing device is mounted in a recess in the upper portion of the rocker arm and connected to said fixed counterpart via a fastening element.

7. Apparatus according to claim 1, wherein the load-sensing device is mounted in a recess in the upper portion of the rocker arm and connected to said fixed counterpart via a fastening element.

8. Apparatus according to claim 7, wherein the load-sensing device is mounted between the rocker arm and the fixed counterpart.

9. Apparatus according to claim 1, wherein a primary arm that holds a core shaft which supports the reel during the reeling phase has a primary bearing assembly and the shaft of the reel drum has another bearing assembly which is located inside and uncoupled from the primary bearing assembly.

10. Apparatus for continuous reeling of a pulp web, comprising:

a machine frame;

a reel drum on a shaft having opposite ends;

respective vertical rocker arms, each having a lower end supported by the machine frame and an upper end supporting an end of the shaft, wherein each rocker arm has an attenuated region closer to the lower end than to the upper end whereby the rocker arm has a swinging motion about the attenuated region;

a winding unit operatively associated with the reel drum to receive the pulp web onto a winding roll from the reel drum at a nip between the reel drum and the winding roll;

means for imparting a pressing load between the reel drum and the winding roll at the nip during continuous reeling;

a load sensing device between each rocker arm and a sensor mount that is fixed with respect to the machine frame, to measure the pressing load at the nip;

a preloading element operatively connected to each rocker arm to establish and maintain a target preload force between the rocker arm and the load sensing device independent of the pressing load; and wherein the preloading element is remotely controllable to adjust the preload force to match a variable target preload force.

11. Apparatus according to claim 10, wherein the preloading element is a hydraulic cylinder.

12. Apparatus according to claim 10, wherein the preloading element is a pneumatic cylinder.

13. Apparatus according to claim 10, wherein the load-sensing device is mounted in a recess in the rocker arm and connected to a fixed counterpart via a fastening element.

14. Apparatus according to claim 13, wherein the load-sensing device is mounted between the rocker arm and the fixed counterpart.

15. Apparatus according to claim 10, wherein a primary arm that holds a core shaft which supports the reel during the reeling phase has a primary bearing assembly and the shaft of the reel drum has another bearing assembly which is located inside and uncoupled from the primary bearing assembly.

16. Apparatus according to claim 10, wherein the attenuated region comprises two opposed recesses.

17. Apparatus according to claim 10, wherein the lower end of the rocker arm is rigidly connected to the machine frame and the attenuated region is vertically above said rigid connection.

18. Apparatus according to claim 17, wherein the attenuated region comprises two opposed recesses.

* * * * *